US010045904B2

(12) United States Patent
Takashima

(10) Patent No.: US 10,045,904 B2
(45) Date of Patent: Aug. 14, 2018

(54) WALKING TRAINING SYSTEM

(71) Applicant: TOYOTA JIDOSHA KABUSHIKI KAISHA, Toyota-shi (JP)

(72) Inventor: Masayuki Takashima, Toyota (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 0 days.

(21) Appl. No.: 15/236,058

(22) Filed: Aug. 12, 2016

(65) Prior Publication Data

US 2017/0065478 A1 Mar. 9, 2017

(30) Foreign Application Priority Data

Sep. 9, 2015 (JP) ..... 2015-177790

(51) Int. Cl.
*A63B 24/00* (2006.01)
*A63B 71/00* (2006.01)
(Continued)

(52) U.S. Cl.
CPC ..... *A61H 1/0262* (2013.01); *A61H 1/024* (2013.01); *A61H 1/0266* (2013.01); *A61H 3/00* (2013.01); *A61H 3/008* (2013.01); *A63B 21/0058* (2013.01); *A63B 21/00181* (2013.01); *A63B 21/4011* (2015.10); *A63B 22/0046* (2013.01); *A63B 22/0242* (2013.01); *A63B 24/0087* (2013.01); *A61H 2201/0176* (2013.01); *A61H 2201/0192* (2013.01); *A61H 2201/1215* (2013.01); *A61H 2201/1261* (2013.01); *A61H 2201/1481* (2013.01); *A61H 2201/165* (2013.01); *A61H 2201/1621* (2013.01);
(Continued)

(58) Field of Classification Search
CPC combination set(s) only.
See application file for complete search history.

(56) References Cited

U.S. PATENT DOCUMENTS 6,821,233 B1 * 11/2004 Colombo ..... A61F 5/0102 482/54
8,480,541 B1 * 7/2013 Brunts ..... A63B 22/0242 482/1
(Continued)

FOREIGN PATENT DOCUMENTS

CN 101862255 A 10/2010
DE 10 2010 004 504 A 7/2011
(Continued)

*Primary Examiner* — Andrew S Lo
*Assistant Examiner* — Shila Jalalzadeh Abyan
(74) *Attorney, Agent, or Firm* — Oblon, McClelland, Maier & Neustadt, L.L.P.

(57) ABSTRACT

A walking training system includes a detection unit that detects whether a leg portion of a walking trainee on which a walking assistance apparatus has been mounted has performed a walking operation or a stepping operation on a belt of a treadmill on which the walking trainee performs walking training, and a controller maintains an operation prohibition state in which a rotational operation of the belt is not started until the time that the detection unit detects the walking operation or the stepping operation a predetermined number of times and cancels the operation prohibition state after the detection unit detects the walking operation or the stepping operation the predetermined number of times.

4 Claims, 4 Drawing Sheets

(51) Int. Cl.

| | |
|---|---|
| ***A61H 1/02*** | (2006.01) |
| ***A63B 22/00*** | (2006.01) |
| ***A61H 3/00*** | (2006.01) |
| ***A63B 22/02*** | (2006.01) |
| ***A63B 21/005*** | (2006.01) |
| ***A63B 21/00*** | (2006.01) |
| *A63B 69/00* | (2006.01) |
| *A63B 71/06* | (2006.01) |

(52) U.S. Cl.

CPC ..... *A61H 2201/1642* (2013.01); *A61H 2201/1652* (2013.01); *A61H 2201/5007* (2013.01); *A61H 2201/5043* (2013.01); *A61H 2201/5048* (2013.01); *A61H 2201/5061* (2013.01); *A61H 2230/80* (2013.01); *A63B 21/4013* (2015.10); *A63B 69/0057* (2013.01); *A63B 71/0622* (2013.01); *A63B 2024/0093* (2013.01); *A63B 2071/0081* (2013.01); *A63B 2071/065* (2013.01); *A63B 2071/0625* (2013.01); *A63B 2220/50* (2013.01); *A63B 2230/01* (2013.01)

(56) References Cited

U.S. PATENT DOCUMENTS

| | | | | |
|---|---|---|---|---|
| 2009/0215588 | A1* | 8/2009 | Riener ..... | A61H 1/0237 482/7 |
| 2010/0000345 | A1* | 1/2010 | Udono ..... | G01M 99/005 73/865.9 |
| 2014/0058299 | A1* | 2/2014 | Sankai ..... | A61B 5/112 601/35 |
| 2015/0342820 | A1 | 12/2015 | Shimada et al. | |

FOREIGN PATENT DOCUMENTS

| | | | | |
|---|---|---|---|---|
| JP | 2002-345994 | A | | 12/2002 |
| JP | 2005-124966 | A | | 5/2005 |
| JP | 2012-095793 | A | | 5/2012 |
| JP | 2012095793 | A | * | 5/2012 |
| JP | 2015-223294 | A | | 12/2015 |

* cited by examiner

WALKING TRAINING SYSTEM

CROSS-REFERENCE TO RELATED APPLICATIONS

This application is based upon and claims the benefit of priority from Japanese patent application No. 2015-177790, filed on Sep. 9, 2015, the disclosure of which is incorporated herein in its entirety by reference.

BACKGROUND OF THE DISCLOSURE

1. Field of the Disclosure

The present disclosure relates to a walking training system.

2. Description of Related Art

A walking training system in which a walking trainee having a leg portion on Which a walking assistance apparatus disclosed in Japanese Unexamined Patent Application Publication No. 2012-95793 is mounted walks on a belt of a treadmill for performing walking training has been developed for practical use. In the above walking training system, an operator such as a physical therapist performs operations for an assistance operation (drive) of the walking assistance apparatus mounted on the walking trainee who is on the belt of the treadmill and a rotational operation (drive) of the belt in the treadmill. The assistance operation of the walking assistance apparatus and the rotational operation of the belt in the treadmill are therefore started based on the operations by the operator.

When, however, the walking trainee performs walking training on the belt of the treadmill using the walking assistance apparatus disclosed in Japanese Unexamined Patent Application Publication No. 2012-95793, if the operator starts the rotational operation of the belt in the treadmill before the walking trainee becomes accustomed to the assistance operation of the walking assistance apparatus, the walking trainee may feel uncomfortable.

SUMMARY OF THE DISCLOSURE

The present disclosure has been made in view of the aforementioned problem and provides a walking training system which can reduce the anxiety of the walking trainee during the walking training.

A walking training system according to one aspect of the present disclosure includes: a treadmill including a belt on which a walking trainee performs walking training, the belt being moved in a rotational manner; a controller that controls the rotational operation of the belt; and a walking assistance apparatus that is mounted on a leg portion of the walking trainee and assists the walking operation of the walking trainee, in which: the walking training system further includes a detection unit that detects whether the leg portion of the walking trainee on which the walking assistance apparatus has been mounted has performed a walking operation or a stepping operation on the belt, and the controller maintains an operation prohibition state in which the rotational operation of the belt is not started until the time that the detection unit detects the walking operation or the stepping operation a predetermined number of times and cancels the operation prohibition state after the detection unit detects the walking operation or the stepping operation the predetermined number of times.

The walking training system stated above includes an operation unit that outputs an operation signal indicating a start of the rotational operation of the belt to the controller according to an operation by an operator, and preferably, the operation unit does not output the operation signal to the controller while the controller maintains the operation prohibition state until the time that the detection unit detects the walking operation or the stepping operation the predetermined number of times.

The walking training system stated above includes an operation unit that outputs an operation signal indicating a start of the rotational operation of the belt to the controller according to an operation by an operator, and even when the operation signal is output to the controller from the operation unit, the controller preferably maintains the operation prohibition state until the time that the detection unit detects the walking operation or the stepping operation the predetermined number of times.

According to the present disclosure, it is possible to provide a walking training system which can reduce the anxiety of the walking trainee during the walking training.

The above and other objects, features and advantages of the present disclosure will become more fully understood from the detailed description given hereinbelow and the accompanying drawings which are given by way of illustration only, and thus are not to be considered as limiting the present disclosure.

DESCRIPTION OF THE EXEMPLARY EMBODIMENTS

<First Embodiment >

Figure 1:
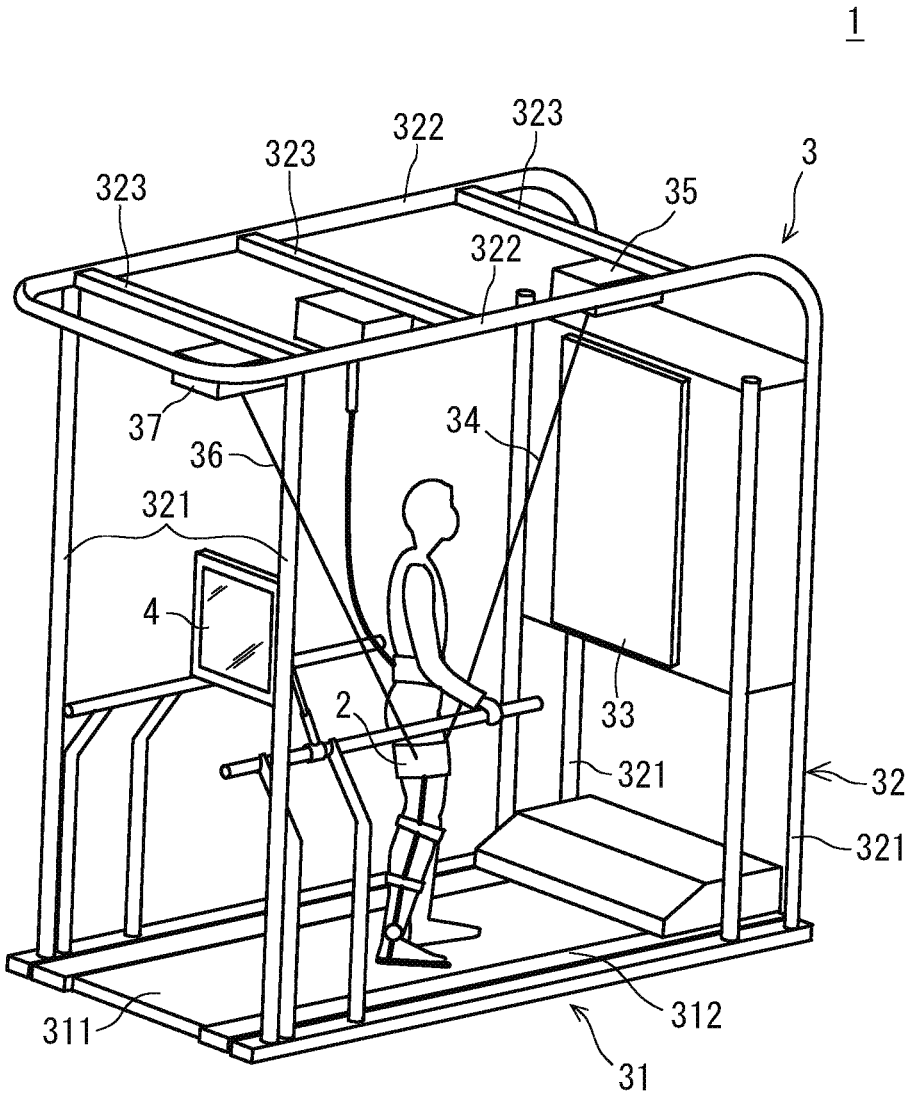
FIG. 1 is a perspective view schematically showing a configuration of a walking training system according to a first embodiment.
Figure 2:
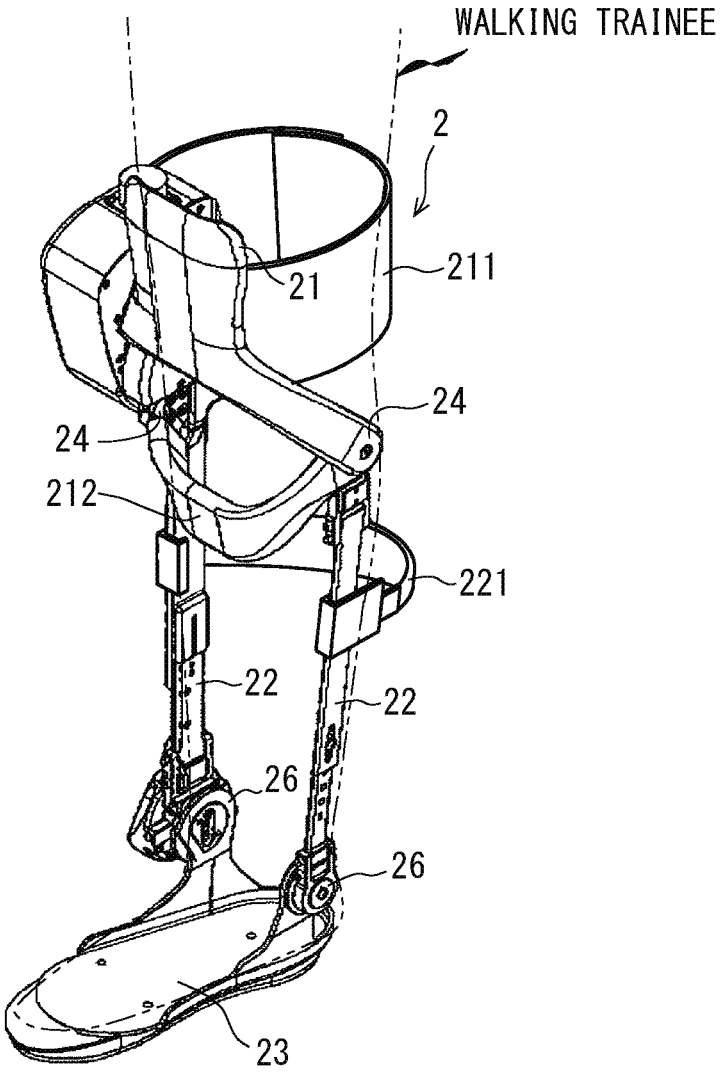
FIG. 2 is a perspective view schematically showing a walking assistance apparatus of the walking training system according to the first embodiment.
Figure 3:
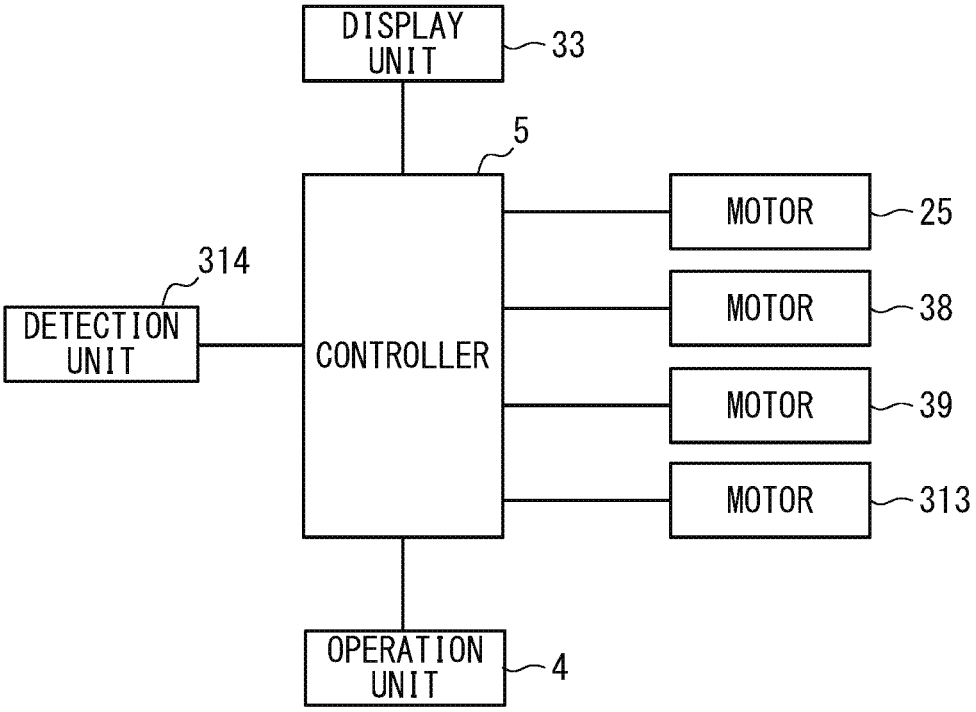
FIG. 3 is a block diagram schematically showing a system configuration of the walking training system according to the first embodiment.

Hereinafter, with reference to the drawings, a walking training system according to an embodiment of the present disclosure will be described. FIG. 1 is a perspective view schematically showing a configuration of the walking training system according to this embodiment. FIG. 2 is a perspective view schematically showing a walking assistance apparatus of the walking training system according to this embodiment. FIG. 3 is a block diagram schematically showing a system configuration of the walking training system according to this embodiment.

As shown in FIG. 1 and 3, a walking training system 1 according to this embodiment is, for example, a device that performs walking training for a walking trainee (e.g., a patient suffering from hemiplegia due to a stroke). The walking training system 1 includes a walking assistance apparatus 2, a training apparatus 3, an operation unit 4, and a controller 5.

As shown in FIG. 2, the walking assistance apparatus 2 is mounted on an affected leg of the walking trainee and assists walking of the walking trainee. The walking assistance apparatus 2 is provided with an upper thigh frame 21, a lower thigh frame 22, and a sole frame 23.

The upper thigh frame 21 is fixed to the upper thigh of the walking trainee via a fixing means 211. The upper thigh frame 21 is provided with a first frame 212 which is formed in a horizontally long shape and extends in the horizontal direction so that the first frame 212 is connected to one end of a first wire 34 of a first pulling unit 35 described later.

The lower thigh frame 22 is fixed to the lower thigh of the walking trainee via a fixing means (not shown). The upper end part of the lower thigh frame 22 is connected to the lower end part of the upper thigh frame 21 via a knee joint 24. The lower thigh frame 22 is provided with a second frame 221 which is formed in a horizontally long shape and extends in the horizontal direction so that the second frame 221 is connected to one end of a second wire 36 of a second pulling unit 37 described later.

The knee joint 24 enables the upper thigh frame 21 and the lower thigh frame 22 to rotate relative to each other by a drive of a motor 25. The motor 25 is driven based on a control signal input from the controller 5.

The sole frame 23 is fixed to the foot via a fixing means (not shown) in a state in which the sole of the walking trainee is placed thereon. The sole frame 23 is connected to the lower end part of the lower thigh frame 22 via an ankle joint 26. The ankle joint 26 enables the lower thigh frame 22 and the sole frame 23 to rotate relative to each other. The fixing means may be, for example, magic tape (registered trademark).

The configuration of the above-described walking assistance apparatus 2 is merely an example, and thus the disclosure is not limited thereto. A desired walking assistance apparatus which is mounted on the leg portion of the walking trainee and can assist the walking of the walking trainee can be adopted. The walking assistance apparatus 2 may be provided with, for example, a motor which rotatably drives the ankle joint 26.

Further, the connection parts of the first pulling unit 35 and the second pulling unit 37 are merely examples and are not limited to those stated above. For example, one end of each of the first wire 34 of the first pulling unit 35 and the second wire 36 of the second pulling unit 37 may be connected to the fixing means 211 and the pulling points of the first pulling unit 35 and the second pulling unit 37 may be provided in desired positions of the walking assistance apparatus 2.

The training apparatus 3 includes, as shown in FIG. 1, a treadmill 31, a frame body 32, and a display unit 33. The treadmill 31 includes, as shown in FIGS. 1 and 3, a belt 311, a supporting part 312, a motor 313, and a detection unit 314.

The belt 311 is an endless belt and rotates so that the upper surface of the belt 311 moves from the front side to the rear side of the treadmill 31. The walking trainee gets on the belt 311 and performs the walking training according to the movement of the belt 311.

The supporting part 312 is a stage that supports the walking trainee who performs the walking training. The belt 311 is provided substantially in the center of the horizontal direction of the supporting part 312 and the outer peripheral surface of the supporting part 312 is surrounded by the inner peripheral surface of the belt 311.

The motor 313 rotatably drives the belt 311. The motor 313 is driven based on the control signal input from the controller 5.

The detection unit 314 detects whether the walking trainee has performed a walking operation or a stepping operation. The walking operation or the stepping operation is an operation in which one leg portion shifts from a supporting leg condition to a lifted leg condition and then the leg portion shifts from the lifted leg condition back to the supporting leg condition and the detection unit 314 detects whether at least the leg portion on which the walking assistance apparatus 2 has been mounted has performed the walking operation or the stepping operation.

The detection unit 314 includes, for example, a load sensor that is provided between the inner peripheral surface of the belt 311 and the upper surface of the supporting part 312 and outputs a detection signal indicating the load applied from the walking trainee who gets on the belt 311 to the controller 5.

The frame body 32 includes two pairs of column frames 321 which are installed on the supporting part 312 of the treadmill 31, a pair of front and rear frames 322 which are connected to the respective column frames 321 and extend in the longitudinal direction, and three right and left frames 323 which are connected to the front and rear frames 322 and extend in the horizontal direction. The configuration of the frame body 32 is not limited to the one described above. The frame body 32 may have any frame configuration as long as the first pulling unit 35 and the second pulling unit 37 which will be described later can be appropriately fixed to the frame body 32.

The right and left frame 323 on the front side is provided with the first pulling unit 35 to which the other end of the first wire 34 is connected. The first pulling unit 35 pulls the first wire 34 to the upper side and the front side. The right and left frame 323 on the rear side is provided with the second pulling unit 37 to which the other end of the second wire 36 is connected. The second pulling unit 37 pulls the second wire 36 to the upper side and the rear side.

The first pulling unit 35 includes a mechanism which winds and rewinds the first wire 34 (not shown) and a motor 38 which drives this mechanism. The mechanism may be a winch, a spool, a pulley, or the like. When the motor 38 is driven to wind the first wire 34 based on the control signal input from the controller 5, the first pulling unit 35 pulls the walking assistance apparatus 2 to the upper side and the front side via the first wire 34.

The second pulling unit 37 includes a mechanism which winds and rewinds the second wire 36 (not shown) and a motor 39 which drives this mechanism. The mechanism may be a winch, a spool, a pulley, or the like. When the motor 39 is driven to wind the second wire 36 based on the control signal input from the controller 5, the second pulling unit 37 pulls the walking assistance apparatus 2 to the upper side and the rear side via the second wire 36.

While the first pulling unit 35 and the second pulling unit 37 control driving torque of the motors 38 and 39 so as to control the pulling forces of the first wire 34 and the second wire 36, the present disclosure is not limited thereto. For example, a spring member may be connected to each of the first wire 34 and the second wire 36 and the pulling forces of the first wire 34 and the second wire 36 may be adjusted by adjusting the elastic force of the spring member.

Components in the vertically upward direction from the pulling forces generated by the first pulling unit 35 and the second pulling unit 37 support the weight of the walking assistance apparatus 2. The components in the horizontal direction of the pulling forces generated by the first pulling unit 35 and the second pulling unit 37 assist the swing of the leg portion. It is therefore possible to reduce a walking load on the walking trainee during the walking training.

Further, the first wire 34 extends from the walking assistance apparatus 2 of the leg portion of the walking trainee to the upper side and the front side and the second wire 36 extends from the walking assistance apparatus 2 of the leg portion of the walking trainee to the upper side and the rear side. Therefore, each of the first wire 34 and the second wire 36 does not interfere with the walking by the walking trainee and thus does not interfere with the walking training.

The display unit 33 is provided in the column frame 321 on the front side of the treadmill 31, with the display surface facing the rear side of the treadmill 31. The display unit 33 displays information such as a training indication based on the control signal input from the controller 5. The walking trainee performs the walking training based on the information such as the training indication displayed on the display unit 33.

The operation unit 4 is an input means for operating the treadmill 31 and the walking assistance apparatus 2 and includes, for example, a touch panel. The operation unit 4 is provided, for example, in the frame body 32.

Various buttons for operating the walking assistance apparatus 2 and the training apparatus 3 (e.g., an assistance start button of the walking assistance apparatus 2, a training start button of the training apparatus 3, a training stop button, a button for adjusting the driving force of the walking assistance apparatus 2, a button for adjusting the rotational speed of the belt 311 of the treadmill 31, and a button for adjusting the pulling force of the first pulling unit 35 and the second pulling unit 37) are displayed on the touch panel of the operation unit 4.

When the operator operates various buttons on the touch panel of the operation unit 4, the operation unit 4 outputs the operation signal according to this operation to the controller 5. Further, the operation unit 4 switches the display of the training start button of the training apparatus 3 from a state in which the operator can select the button and the display of the training start button of the training apparatus 3 to a state in which the operator cannot select the button based on the control signal input from the controller 5.

The controller 5 controls the walking assistance apparatus 2 and the training apparatus 3 based on the operation signal input from the operation unit 4. Further, the controller 5 controls the operation unit 4 based on the detection signal input from the detection unit 314.

At this time, the controller 5 derives the number of times the walking operation or the stepping operation is performed by the walking trainee based on the load applied from the walking trainee who gets on the belt 311. When the number of times the walking operation or the stepping operation is performed by the walking trainee that has been derived is smaller than a predetermined number, the controller 5 maintains an operation prohibition state (i.e., an operation prohibition state of the treadmill 31) in which the training apparatus 3, and more particularly, the rotational operation of the belt 311 in the treadmill 31 cannot be started. Further, when the number of times the walking operation or the stepping operation is performed by the walking trainee that has been derived reaches the predetermined number, the controller 5 cancels the operation prohibition state of the treadmill 31.

The controller 5 determines, for example, that the leg portion of the walking trainee is in the supporting leg condition when the load detected by the detection unit 314 is equal to or larger than a predetermined first threshold and determines that the leg portion of the walking trainee is in the lifted leg condition when the load is equal to or smaller than a predetermined second threshold. The controller 5 then derives the number of times of the walking operation or the stepping operation of at least the leg portion of the walking trainee on which the walking training system 2 has been mounted based on the number of times that the condition of the leg portion of the walking trainee has become the supporting leg condition or the number of times that it has become the lifted leg condition.

When the number of times the walking operation or the stepping operation is performed by the walking trainee that has been derived reaches the predetermined number, the controller 5 cancels the operation prohibition state of the treadmill 31 and outputs the control signal indicating the display of the training start button of the training apparatus 3 in the state in which the operator can select the button to the operation unit 4. On the other hand, when the number of times the walking operation or the stepping operation is performed by the walking trainee that has been derived is smaller than the predetermined number, the controller 5 maintains the operation prohibition state of the treadmill 31 and outputs the control signal indicating the display of the training start button of the training apparatus 3 in the state in which the operator cannot select the button to the operation unit 4.

The controller 5 has a hardware configuration, for example, mainly including a microcomputer which is formed of a central processing unit (CPU) which performs an operating process, a control process or the like, a read only memory (ROM) which stores an operation program performed by the CPU, a control program, or the like, a random access memory (RAM) which stores various items of data, an interface unit (I/F) which performs input and output of signals from the outside, and the like. The CPU, the ROM, the RAM, and the interface unit are connected to one another via a data bus. The controller 5 is included, for example, in the display unit 33.

In the above walking training system 1, when the operator selects the assistance start button of the walking assistance apparatus 2 on the touch panel of the operation unit 4, for example, the operation unit 4 outputs a start indication signal (operation signal) which starts the drive of the walking assistance apparatus 2 to the controller 5. The controller 5 outputs the control signal to start the drive of the walking assistance apparatus 2 to the motor 25 of the walking assistance apparatus 2. The assistance operation of the walking assistance apparatus 2 is thus started.

In a similar way, when the operator selects the training start button of the training apparatus 3 on the touch panel of the operation unit 4, the operation unit 4 outputs the start indication signal (operation signal) which starts the drive of the training apparatus 3 to the controller 5. The controller 5 outputs the control signal to start the drive of the training apparatus 3 to the motor 313 of the treadmill 31, the motor 38 of the first pulling unit 35, and the motor 39 of the second pulling unit 37. Accordingly, the rotational operation of the belt 311 of the treadmill 31 and the pulling operations of the first pulling unit 35 and the second pulling unit 37 are started. That is, the training start button of the training apparatus 3 functions as the operation unit operated by the operator to start the rotational operation of the belt 311 in the treadmill 31. Further, the controller 5 outputs a display signal indicating information such as the training indication to the display unit 33. The display unit 33 thus displays information such as the training indication.

Further, when the operator selects the training stop button on the touch panel of the operation unit 4, the operation unit 4 outputs a stop indication signal (operation signal) which stops the drive of the walking assistance apparatus 2 and the training apparatus 3 to the controller 5. The controller 5 outputs the control signal to stop the drive of the walking assistance apparatus 2 to the motor 25 of the walking assistance apparatus 2. The assistance operation of the walking assistance apparatus 2 is thus ended. Further, the controller 5 outputs the control signal to stop the drive of the training apparatus 3 to the motor 313 of the treadmill 31, the motor 38 of the first pulling unit 35, the motor 39 of the second pulling unit 37, and the display unit 33. Accordingly, the rotational operation of the belt 311 in the treadmill 31, the pulling operations of the first pulling unit 35 and the second pulling unit 37, and the display of the information such as the training indication in the display unit 33 are ended.

Figure 4:
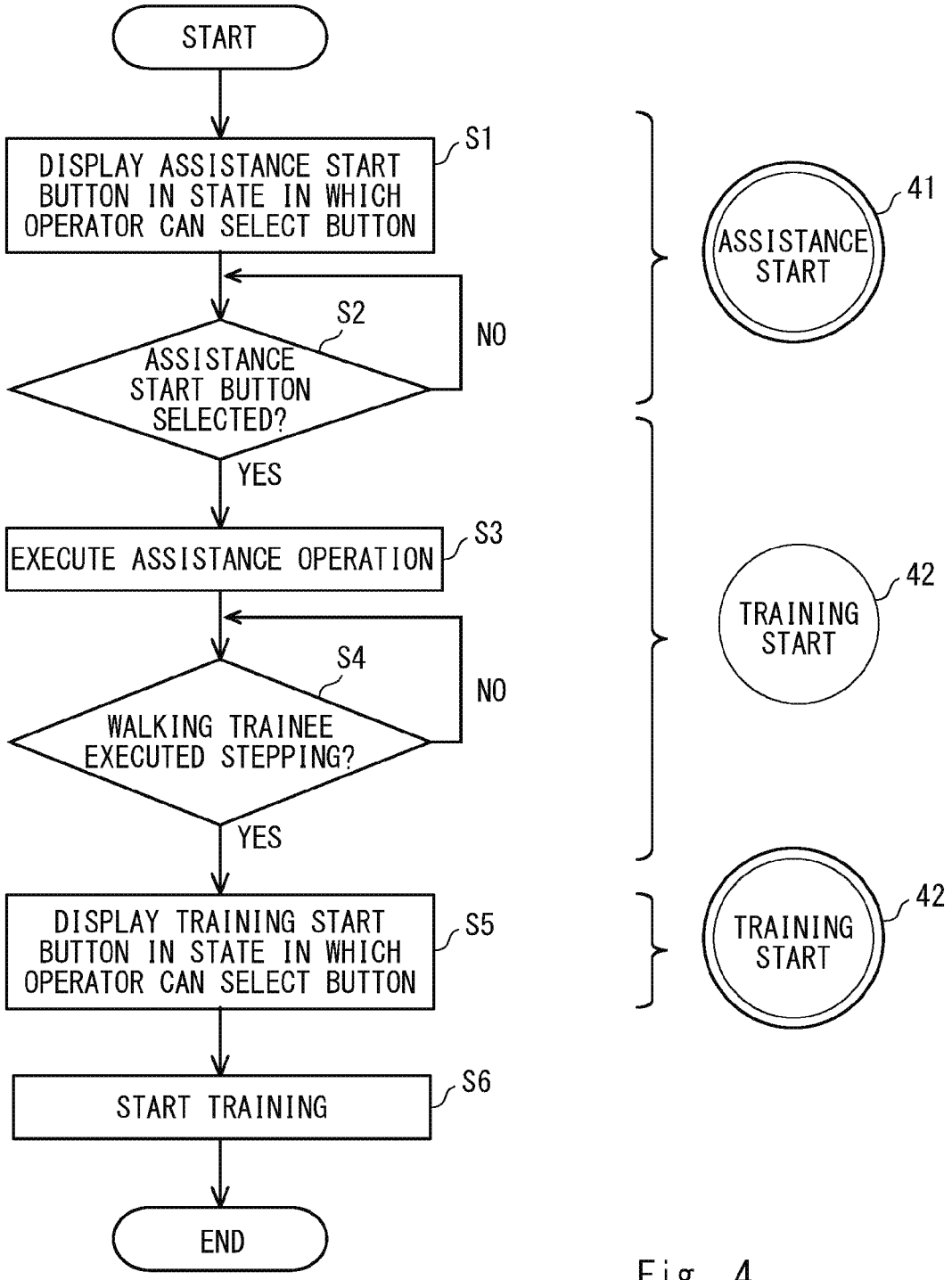
FIG. 4 is a flowchart showing a flow of a start of training of the walking training system according to the first embodiment.

Next, a flow of the start of the training of the walking training system 1 according to this embodiment will be described. FIG. 4 is a flowchart showing a flow of the start of the training of the walking training system according to this embodiment. The diagram on the left side of FIG. 4 shows the processes of the flow of the start of the training of the walking training system according to this embodiment and the diagram on the right side of FIG. 4 shows the display state of the assistance start button 41 of the walking assistance apparatus 2 or the training start button 42 of the training apparatus 3 corresponding to the respective processes.

In FIG. 4, when the ring that surrounds the assistance start button 41 of the walking assistance apparatus 2 and the training start button 42 of the training apparatus 3 is a double ring, it means that the operator can select the button, and when the ring that surrounds the assistance start button 41 of the walking assistance apparatus 2 and the training start button 42 of the training apparatus 3 is a single ring, it mans that the operator cannot select the button. However, the structures of the assistance start button 41 of the walking assistance apparatus 2 and the training start button 42 of the training apparatus 3 are not limited to those stated above and the assistance start button 41 of the walking assistance apparatus 2 and the training start button 42 of the training apparatus 3 may have any design as long as it is possible to discriminate the state in which the operator can select the button from the state in which the operator cannot select the button.

First, when the operator turns on a main switch (not shown) of the walking training system 1, the controller 5 displays, as shown in the upper stage on the right side of FIG. 4, the content so that the operator can select the assistance start button 41 of the walking assistance apparatus 2 (S1). At this time, the controller 5 is in the operation prohibition state of the treadmill 31. Further, the training start button 42 of the training apparatus 3 is not displayed. However, the training start button 42 of the training apparatus 3 may be displayed in the state in which the operator cannot select the button.

The operator selects the assistance start button 41 of the walking assistance apparatus 2, whereby the controller 5 determines whether the start indication signal that indicates the start of the drive of the walking assistance apparatus 2 has been input from the operation unit 4 (S2).

Next, when the start indication signal that indicates the start of the drive of the walking assistance apparatus 2 is input from the operation unit 4 (YES in S2), the controller 5 starts the control of the motor 25 of the walking assistance apparatus 2 while maintaining the operation prohibition state of the treadmill 31 (S3). The walking trainee thus starts the stepping operation on the treadmill 31.

At this time, in this embodiment, when the operator selects the assistance start button 41 of the walking assistance apparatus 2, the controller 5 controls, as shown in the middle stage on the right side of FIG. 4, the operation unit 4 so that the display of the assistance start button 41 of the walking assistance apparatus 2 is switched to the display of the training start button 42 of the training apparatus 3 in the state in which the operator cannot select the button.

On the other hand, when the start indication signal that indicates the start of the drive of the walking assistance apparatus 2 is not input from the operation unit 4 (NO in S2), the controller 5 goes back to the process of S2 while keeping the operation prohibition state of the treadmill 31.

Next, the controller 5 determines, based on the detection signal input from the detection unit 314, whether the leg portion of the walking trainee on which the walking assistance apparatus 2 has been mounted has performed the stepping operation on the treadmill 31 the predetermined number of times (S4). Otherwise, it may be determined whether the number of times the stepping operation of both of the legs of the walking trainee is performed has reached a predetermined number.

When the controller 5 determines that the walking trainee has not performed the stepping operation on the treadmill 31 the predetermined number of times (NO in S4), the controller 5 controls the operation unit 4 so that the training start button 42 of the training apparatus 3 is displayed in the state in which the operator cannot select the button while maintaining the operation prohibition state of the treadmill 31, and the process goes back to S4.

As a result, as shown in the middle stage on the right side of FIG. 4, the operation unit 4 keeps displaying the training start button 42 of the training apparatus 3 in the state in which the operator cannot select the button. The operation unit 4 then keeps displaying the training start button 42 of the training apparatus 3 in the state in which the operator cannot select the button until the time that the number of times the stepping operation is performed reaches the predetermined number.

Even when the training start button 42 of the training apparatus 3 in this state is selected, the selection by the operator is invalidated. That is, even when the operator touches the training start button 42 of the training apparatus 3 in the state in which the operator cannot select the button, the operation unit 4 does not output the start indication signal to indicate the start of the drive of the training apparatus 3 to the controller 5. As described above, even when the operator operates the operation unit 4, the operation signal is not output to the controller 5 until the time that the walking trainee performs the walking operation or the stepping operation the predetermined number of times. It is therefore possible to suppress the state in which the belt 311 starts the rotational operation as a result of the operation by the operator before the walking trainee becomes accustomed to the assistance operation of the walking assistance apparatus 2 and thus the walking trainee feels uncomfortable. Alternatively, the training start button 42 of the training apparatus 3 may not be displayed until the time that the number of times the stepping operation is performed reaches the predetermined number.

The number of times the stepping operation is performed may be the number of times that it has to be performed in order for the walking trainee to become accustomed to the assistance operation of the walking assistance apparatus 2. At this time, the number of times the stepping operation is performed may either be set in the controller 5 in advance or be input via the operation unit 4.

While the walking trainee executes the stepping operation as a depressing operation in this embodiment, the walking trainee may move forward or backward (i.e., walking operation) within a predetermined walking training area (i.e., the area in which the load sensor of the detection unit 314 is arranged and the area in which the pulling forces can be accurately applied to the walking assistance apparatus 2 via the first wire 34 and the second wire 36 by the first pulling unit 35 and the second pulling unit 37) on the belt 311 of the treadmill 31. Further, the stepping operation may be executed by only the leg portion on which the walking assistance apparatus 2 has been mounted, not both legs of the walking trainee.

On the other hand, when the controller 5 determines that the walking trainee has executed the stepping operation the predetermined number of times on the treadmill 31 (YES in S4), the controller 5 controls the operation unit 4 so that the training start button 42 of the training apparatus 3 is displayed in the state in which the operator can select the button while cancelling the operation prohibition state of the treadmill 31. As a result, the operation unit 4 switches the state of the training start button 42 of the training apparatus 3 which cannot be selected by the operator as shown in the middle stage on the right side of FIG. 4 to the state of the training start button 42 of the training apparatus 3 which can be selected by the operator as shown in the lower stage on the right side of FIG. 4 (S5).

When the operator selects the training start button 42 of the training apparatus 3, the controller 5 starts the control of the motor 313 of the treadmill 31, the motor 38 of the first pulling unit 35, and the motor 39 of the second pulling unit 37 and causes the display unit 33 to display the training indication and the like (S6). The walking trainee then starts a predetermined walking training on the treadmill 31.

As described above, the walking training system 1 according to this embodiment is configured to prohibit the start of the rotational operation of the belt 311 in the treadmill 31 until the time that the walking trainee performs the walking operation or the stepping operation the predetermined number of times. It is therefore possible to suppress the state in which the walking training is started before the walking trainee becomes accustomed to the assistance operation of the walking assistance apparatus 2 and thus the walking trainee feels uncomfortable.

In addition, in this embodiment, when the number of times the walking operation or the stepping operation is performed by the walking trainee detected by the detection unit 314 reaches the predetermined number, the state in which the training start button 42 of the training apparatus 3 cannot be selected is switched to the state in which it can be selected, whereby the operator can easily recognize whether the number of times the walking operation or the stepping operation is performed by the walking trainee has reached the predetermined number.

In the controller 5 according to this embodiment, the operation prohibition state of the treadmill 31 is canceled when the controller 5 determines that the walking trainee has performed the walking operation or the stepping operation the predetermined number of times on the treadmill 31. Alternatively, the operation prohibition state of the treadmill 31 may be cancelled when the start indication signal is input from the operation unit 4 as a result of the selection of the training start button 42 of the training apparatus 3.

<Second Embodiment >

In the first embodiment, the training start button 42 of the training apparatus 3 is displayed on the operation unit 4 in the state in which the operator cannot select the button until the time that the predetermined number of walking operations or the stepping operations by the walking trainee is detected. However, the present disclosure is not limited to the example stated above. Regardless of the number of times the walking operation or the stepping operation is performed by the walking trainee, the training start button 42 of the training apparatus 3 may be displayed on the operation unit 4 in the state in which the operator can select the button. At this time, when the operator selects the training start button 42 of the treadmill 31 in the state in which the number of walking operations or stepping operations by the walking trainee is smaller than the predetermined number, the controller 5 invalidates the operation signal input from the operation unit 4, whereby the operation prohibition state of the treadmill 31 may be maintained until the time that the detection unit 314 detects the predetermined number of walking operations or the stepping operations by the walking trainee. As stated above, until the time that the walking trainee executes the walking operations or the stepping operations the predetermined number of times, even when the operator operates the operation unit 4 and the operation signal is output to the controller 5, this operation signal is invalidated and the operation prohibition state is maintained. It is therefore possible to suppress the state in which the belt 311 starts to be rotated by the operation of the operator before the walking trainee becomes accustomed to the assistance operation of the walking assistance apparatus 2 and thus the walking trainee feels uncomfortable.

<Third Embodiment >

In the first embodiment, the detection unit 314 including the load sensor arranged between the inner peripheral surface of the belt 311 and the upper surface of the supporting part 312 detects the number of times the walking operation or the stepping operation is performed by the walking trainee. However, the present disclosure is not limited to the example stated above. A plurality of load sensors may be provided as the detection unit on the upper surface of the sole frame 23 in the walking assistance apparatus 2 and the controller 5 may derive the number of times the walking operation or the stepping operation is performed by the walking trainee based on the results of the detection in the load sensors.

Further, the number of times the walking operation or the stepping operation is performed by the walking trainee may be derived based on the result of the detection in a time series of an encoder mounted on the motor 25 of the walking assistance apparatus 2.

From the disclosure thus described, it will be obvious that the embodiments of the disclosure may be varied in many ways. Such variations are not to be regarded as a departure from the spirit and scope of the disclosure, and all such modifications as would be obvious to one skilled in the art are intended for inclusion within the scope of the following claims.

What is claimed is:

1. A walking training system comprising:

a treadmill including a belt configured on which a walking trainee performs walking training, the belt being moved in a rotational manner;

a walking assistance apparatus that is configured to be mounted on a leg portion of the walking trainee and assists a walking operation or a stepping operation of the walking trainee;

a detection unit that detects the number of times the leg portion of the walking trainee on which the walking assistance apparatus has been mounted has performed the walking operation or the stepping operation on the belt; and a controller that control the rotational operation of the belt and the walking assistance apparatus, wherein:

when a start indication signal that indicates a start of the walking assistance apparatus is input to the controller according to a first operation by an operator, the controller controls a motor of the walking assistance apparatus in order to assist the walking trainee perform the walking operation or the stepping operation, and the controller maintains an operation prohibition state in which the rotational operation of the belt is not started from the time that the start indication signal has been input until the time that the detection unit detects the walking operation or the stepping operation a predetermined number of times and cancels the operation prohibition state and allows the rotational operation of the belt according to a second operation by the operator to be performed after the detection unit detects the walking operation or the stepping operation the predetermined number of times.

2. The walking training system according to claim 1, comprising:

an operation unit that outputs an operation signal indicating a start of the rotational operation of the belt to the controller according to the second operation by the operator, wherein the operation unit does not output the operation signal to the controller while the controller maintains the operation prohibition state until the time that the detection unit detects the walking operation or the stepping operation the predetermined number of times.

3. The walking training system according to claim 1, comprising:

an operation unit that outputs an operation signal indicating a start of the rotational operation of the belt to the controller according to the second operation by the operator, wherein, even when the operation signal is output to the controller from the operation unit, the controller maintains the operation prohibition state until the time that the detection unit detects the walking operation or the stepping operation the predetermined number of times.

4. A method for walking training comprising:

providing a treadmill including a belt on which a walking trainee performs walking training, the belt being moved in a rotational manner;

mounting a walking assistance apparatus on a leg portion of the walking trainee;

controlling, by a controller, a motor of the walking assistance apparatus in order to assist the walking trainee perform a walking operation or a stepping operation according to a first operation by an operator;

detecting, by a detecting unit, the number of times the leg portion of the walking trainee has performed a walking operation or a stepping operation on the belt;

operating, by the controller, the treadmill in an operation prohibition state in which the rotational operation of the belt is not started until the walking operation or the stepping operation has been detected a predetermined number of times; and canceling, by the controller, the operation prohibition state and allowing the rotational operation of the belt according to a second operation by the operator to be performed after the walking operation or the stepping operation has been detected the predetermined number of times.

* * * * *